US005896752A

United States Patent [19]

Park

[11] Patent Number: 5,896,752

[45] Date of Patent: Apr. 27, 1999

[54] REFRIGERATOR FOR DISCHARGING COOL AIR FROM A DOOR BY USING AN AIR CURTAIN GENERATING DEVICE

[75] Inventor: Hyun-Keun Park, Incheon, Rep. of Korea

[73] Assignee: Daewoo Electronics Co., LTD., Seoul, Rep. of Korea

[21] Appl. No.: 08/828,013

[22] Filed: Mar. 27, 1997

[30] Foreign Application Priority Data

Feb. 20, 1997 [KR] Rep. of Korea ..... 97-2622

[51] Int. Cl.[6] ..... F25D 17/08

[52] U.S. Cl. ..... 62/186; 62/208; 62/256

[58] Field of Search ..... 62/186, 256, 407, 62/419, 426, 208, 209

[56] References Cited

U.S. PATENT DOCUMENTS

| | | | |
|---|---|---|---|
| 2,994,209 | 8/1961 | Mann et al. | 62/209 |
| 4,368,622 | 1/1983 | Brooks | 62/419 |
| 4,379,391 | 4/1983 | Rhee | 62/256 |
| 4,478,047 | 10/1984 | Ibrahim | 62/256 |
| 4,926,649 | 5/1990 | Battocletti | 62/256 |
| 5,319,937 | 6/1994 | Fritsch et al. | 62/426 |
| 5,584,191 | 12/1996 | Kwon | 62/407 |

*Primary Examiner*—William E. Tapolcai
*Attorney, Agent, or Firm*—Jacobson, Price, Holman & Stern, PLLC

[57] ABSTRACT

A refrigerator for discharging cool air from a door is disclosed. The refrigerator has an air curtain generating device and a door duct. The door duct is disposed in the door and combined with the device when the door is closed. When the door is closed, the cool air from the device is supplied into the cooling compartment through the door duct. Thus the degree of cooling in the cooling compartment can be maintained uniformly. When the door is opened, the air curtain for shutting off the opening of cooling compartment is generated by the device.

6 Claims, 3 Drawing Sheets

REFRIGERATOR FOR DISCHARGING COOL AIR FROM A DOOR BY USING AN AIR CURTAIN GENERATING DEVICE

BACKGROUND OF THE INVENTION

1. Field of the Invention

The present invention relates to a refrigerator for discharging cool air from a door by using an air curtain generating device, and more particularly to a refrigerator having a device for generating an air curtain for shutting off the opening of a cooling compartment when the door is opened and a door duct for supplying the cooling compartment with the cool air provided from the device when the door is closed.

2. Prior Art

FIG. 1 shows a conventional refrigerator, which shows a refrigerator having a device for generating an air curtain for shutting off the opening of a cooling compartment. The refrigerator has, as shown in FIG. 1, a cabinet 10 forming a freezing compartment 21 and a fresh food compartment 22 which are partitioned from each other by a wall 27, and a freezing compartment door 24 and a fresh food compartment door 25 which open/close the freezing compartment 21 and fresh food compartment 22, respectively. The doors 24, 25 are hingedly mounted on the cabinet 10.

A compressor 23 is installed in a lower rear part of the cabinet 10, and an evaporator 29 is installed in a rear part of the freezing compartment 21 for generating cool air by evaporating refrigerant supplied from the compressor 23. A cooling fan 19 for blowing the cool air generated by the evaporator 29 is installed at the upper side of the evaporator 29 so as to supply the freezing compartment 21 and the fresh food compartment 22 with the cool air.

A device 20 for generating an air curtain is provided in the upper side of the fresh food compartment 22. The air curtain generating device 20 comprises a cool air duct 13 provided in the upper side of the fresh food compartment 22, and a blowing fan 11 for blowing the cool air from the evaporator 29 into the cool air duct 13. The cool air duct 13 is formed with a cool air discharge port 15 at one end thereof which is opened downward at the area adjacent to an opening of the fresh food compartment 22. The cool air blown into the cool air duct 13 is discharged downward, by which the air curtain for shutting off the opening of the fresh food compartment 22 is generated.

In the fresh food compartment 22, a sensor (not shown) for sensing the opening/closing of the fresh food compartment door 25 is provided, and the blowing fan 11 is controlled to operate only when the opening of the door 25 is sensed by the sensor. Thus, the air curtain is generated only when the door 25 is opened so as to prevent leakage of the cool air through the opening of the fresh food compartment 22 when the door 25 is opened.

A plurality of cool air ports 16, 18 are formed at the rear surfaces of the freezing compartment 21 and the fresh food compartment 22. When the door 25 is closed, the cool air from the evaporator 29 is blown by the cooling fan 19 so as to be supplied into the freezing compartment 21 and the fresh food compartment 22, and accordingly the foodstuffs stored in the freezing compartment 21 and the fresh food compartment 22 are frozen and refrigerated, respectively.

However, in such a conventional refrigerator, although the leakage of the cool air is prevented by the air curtain, since the cool air in the area adjacent to the door 25 comes in contact with exterior air when the door 25 is opened and leaks through a gap between the door 25 and the cabinet 10 when the door 25 is closed, there is a problem that the temperature of the fresh food compartment 22 in the area adjacent to the door 25 may fall in comparison with the temperature at the other areas in the fresh food compartment 22. Furthermore, according to the tendency for the refrigerator to become larger in size, since the distribution of temperature in each area in the fresh food compartment 22 may become more uneven, the foodstuffs stored in the fresh food compartment 22 may be over cooled or under cooled.

SUMMARY OF THE INVENTION

The present invention has been proposed to overcome the above described problems in the prior art, and accordingly it is the object of the present invention to provide a refrigerator being capable of keeping the temperature in the cooling compartment even and thus enhance the efficiency of cooling, by effectively eliminating the leakage of cool air through the opening of the cooling compartment and supplying cool air from the inner surface of the door, and especially to provide a refrigerator in which the air curtain generating device is diversified in use thereof by supplying cool air from the door by using the air curtain generating device.

To achieve the above object, the present invention provides a refrigerator having a cabinet forming a cooling compartment of which a side is opened, a door for opening/closing an opening of the cabinet, and an evaporator for generating cool air, the refrigerator comprising: a device for generating an air curtain, the device having a cool air duct which has a cool air discharge port opened at an area adjacent to the opening of the cabinet and a means for blowing the cool air generated by the evaporator into the cool air duct, the air curtain for shutting off the opening of the cabinet with cool air discharged through the cool air discharge port; and a door duct being disposed in the door and having a cool air suction port which is combined with the cool air discharge port when the door is closed and a plurality of cool air supply ports opened at an inner surface of the door, the door duct for supplying the cooling compartment with the cool air provided from the device through the cool air discharge port when the door is closed.

Here, it is preferable that the refrigerator has a means for sensing a temperature in the cooling compartment and the blowing means is controlled on the basis of the sensed temperature by the temperature sensing means. The temperature sensing means may be comprised of a door temperature sensor disposed adjacently to the inner surface of the door so as to sense a temperature at an area adjacent to the door in the cooling compartment, and a cooling compartment temperature sensor disposed adjacently to an inner surface of the cooling compartment which is opposite to the inner surface of the door so as to sense a temperature at a distant area from the door in the cooling compartment. It that situation, the blowing means is controlled to operate when the temperature sensed by the door temperature sensor is higher than the temperature sensed by the cooling compartment temperature sensor.

Furthermore, the refrigerator according to the present invention has a means for sensing the opening/closing of the door, and the blowing means is controlled to operate when an opened state of the door is sensed by the opening/closing sensing means, so that the leakage of the cool air is prevented by the air curtain whenever the door is opened.

Also, it is more preferable that a plurality of cool air openings for supplying the cool air generated by the evaporator are formed at each inner surface of the cooling compartment, so that the cool air is uniformly distributed in the cooling compartment.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the drawings.

Figure 1:
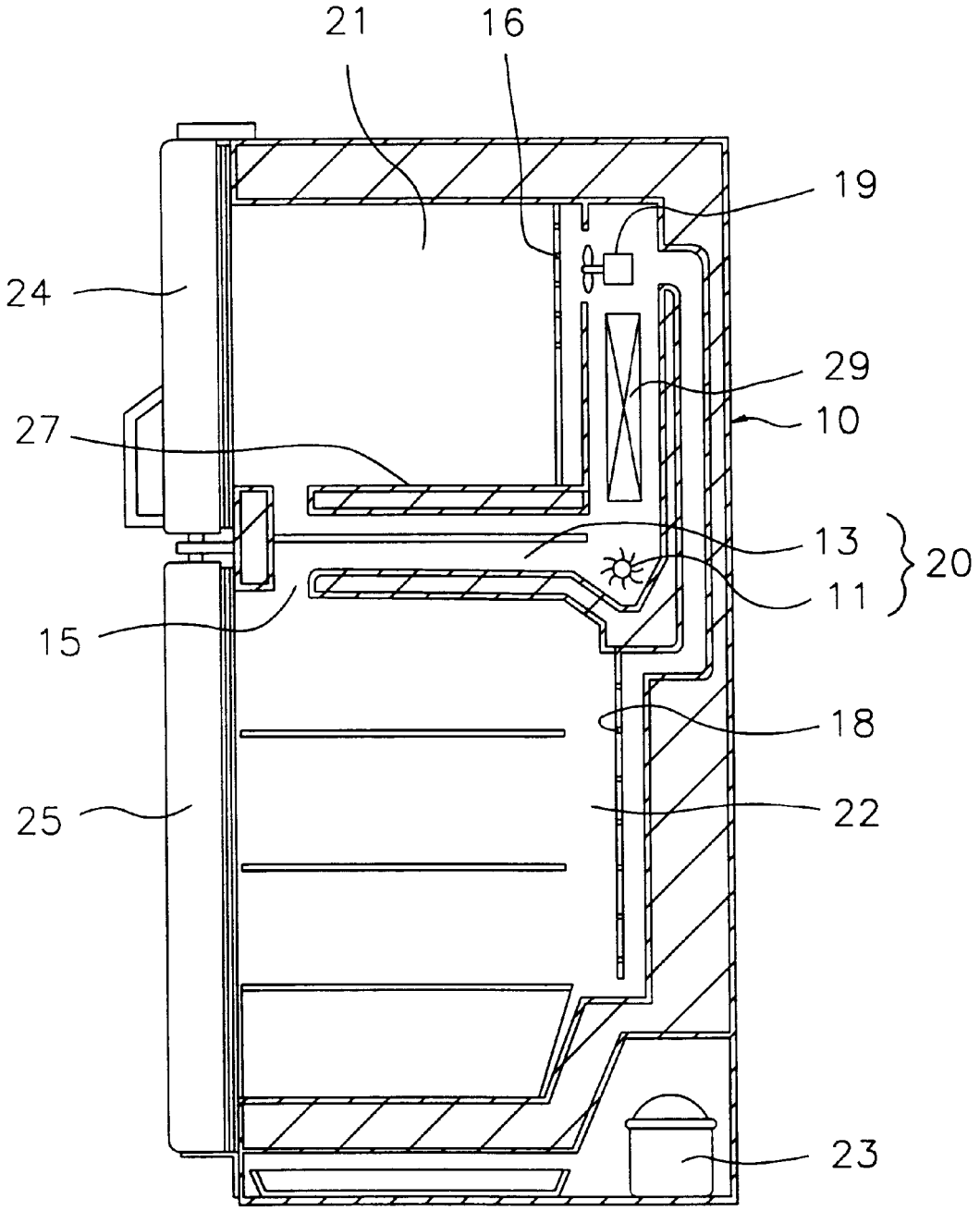
FIG. 1 PRIOR ART
FIG. 1 is a side sectional view of a conventional refrigerator having an air curtain generating device.
Figure 2:
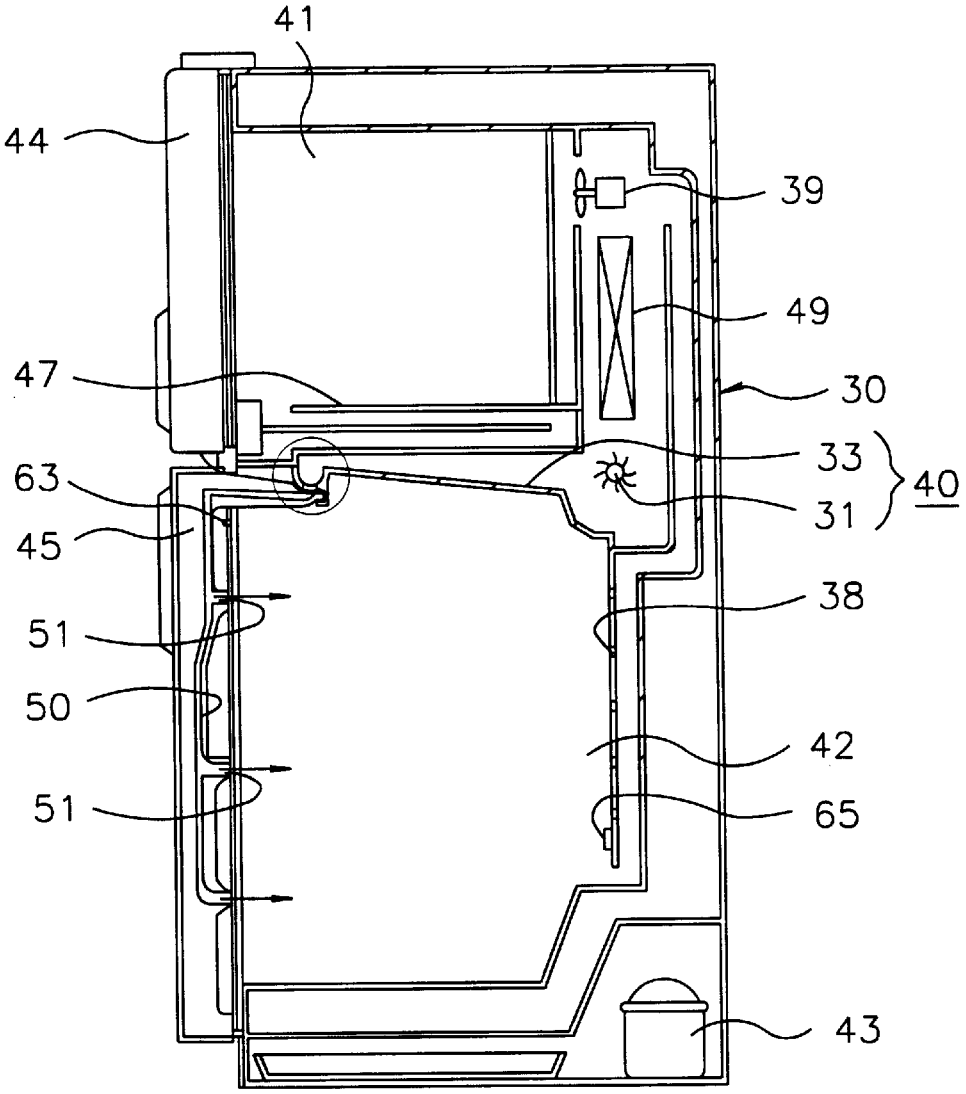
FIG. 2 is a side sectional view of a refrigerator according to the present invention.
Figure 2A:
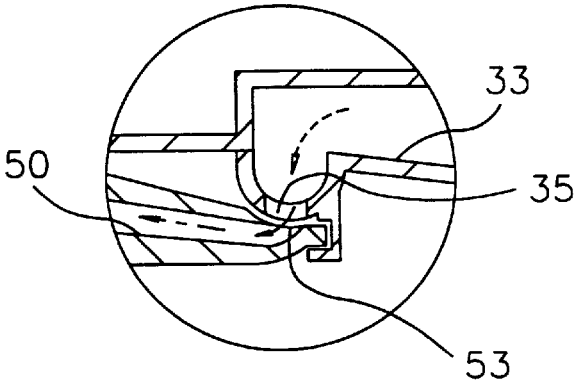
FIG. 2A is an enlarged detail of the cool air discharge port and cool air suction port depicted in FIG. 2.
Figure 3:
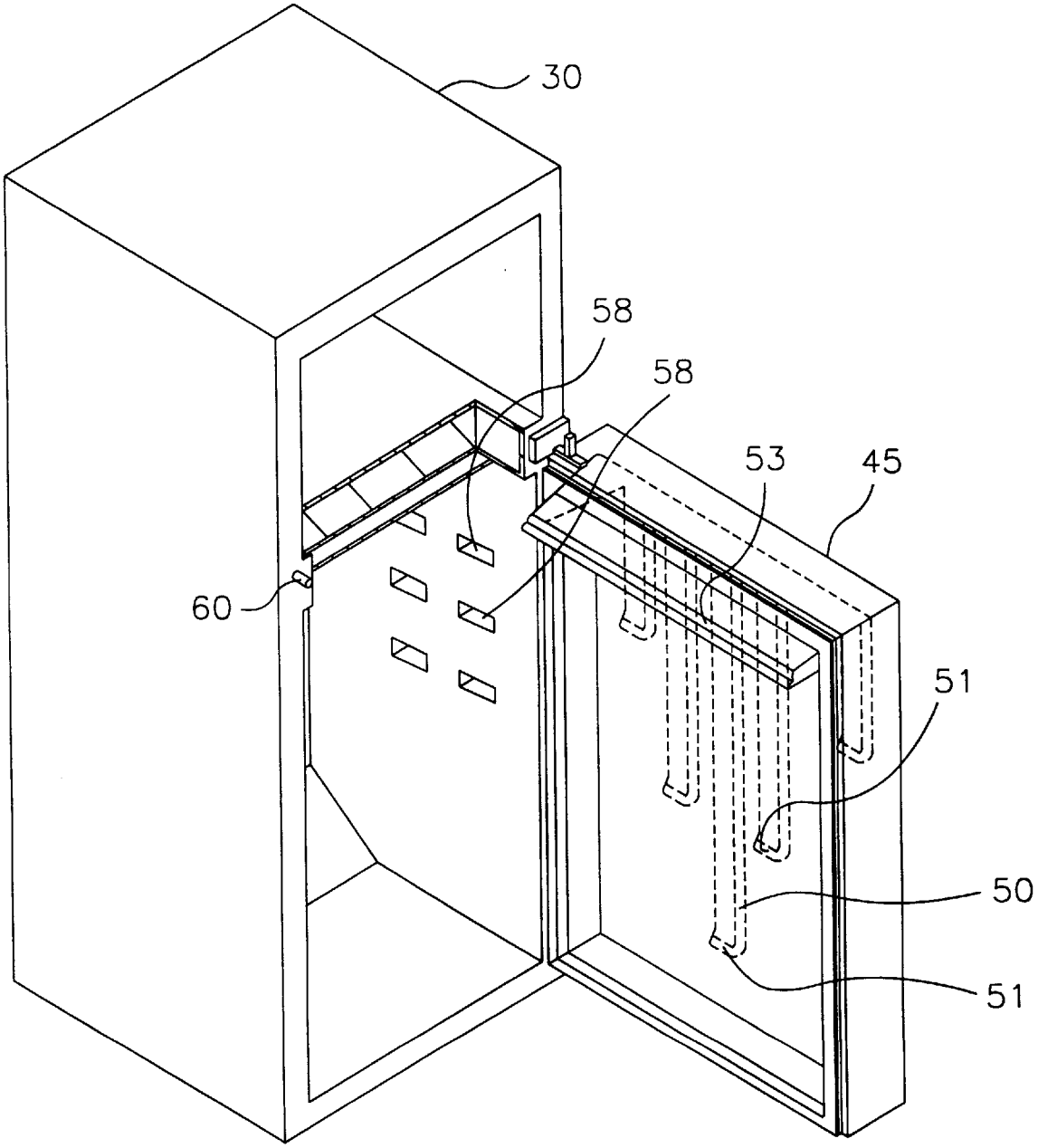
FIG. 3 is a schematic perspective of the refrigerator in FIG. 2.

FIG. 2 is a side sectional view of a refrigerator according to the present invention; FIG. 2A is an enlarged detail of the cool air discharge port and cool air suction port depicted in FIG. 2 and FIG. 3 is a schematic perspective of the refrigerator in FIG. 2. The refrigerator according to the present invention has, like the conventional refrigerator shown in FIG. 1, a cabinet 30 forming a freezing compartment 41 and a fresh food compartment 42 which are partitioned from each other by a wall 47, and a freezing compartment door 44 and a fresh food compartment door 45 which open/close the freezing compartment 41 and fresh food compartment 42 respectively. The doors 44, 45 are hingedly mounted on the cabinet 30.

In a lower rear part of the cabinet 30 a compressor 43 is installed, and in a rear part of the freezing compartment 41 an evaporator 49 is installed for generating cool air by evaporating refrigerant supplied from the compressor 43. At the upper side of the evaporator 49 a cooling fan 39 for blowing the cool air generated by the evaporator 49 is installed so as to supply the freezing compartment 41 and the fresh food compartment 42 with the cool air.

A device 40 for generating an air curtain is provided in the upper side of the fresh food compartment 42. The air curtain generating device 40 comprises a cool air duct 33 provided in the upper side of the fresh food compartment 42 and a blowing fan 31 for blowing the cool air from the evaporator 49 into the cool air duct 33. The cool air duct 33 is formed with a cool air discharge port 35 at one end thereof which is opened downward at the area adjacent to an opening of the fresh food compartment 42. The cool air blown into the cool air duct 33 is discharged downward, by which the air curtain for shutting off the opening of the fresh food compartment 42 is generated. For the blowing fan 31, a cross flow fan which is capable of blowing uniformly is adopted.

A door duct 50 is disposed in the fresh food compartment door 45. The door duct 50 has a cool air suction port 53 which is opened at an upper part of the door 45 and a plurality of cool air supply ports 51 opened at an inner surface of the door 45. The cool air suction port 53 is combined with the cool air discharge port 35 when the the door 45 is closed. Thus, when the door 45 is closed, the cool air provided from the air curtain generating device 40 is supplied into the door duct 50 through the cool air suction port 53, and the cool air supplied into the door duct 50 is supplied into the fresh food compartment 45 through the cool air supply ports 51.

A push button switch 60 is installed on the front surface of the fresh food compartment 42. The push button switch 60 is pushed by the door 45 when the door 45 is closed and released when the door 45 is opened. A microprocessor(not shown) installed in the refrigerator senses that the door 45 is opened when the push button switch 60 is released. The blowing fan 31 operates when the opening of the door 45 is sensed through the push button switch 60. Thus, the air curtain is generated when the door 45 is opened so that the leakage of the cool air when the door 45 is opened is eliminated.

Two temperature sensors 63, 65 are provided in the fresh food compartment 42. The temperature sensors 63, 65 consist of a door temperature sensor 63 disposed adjacently to the inner surface of the door 45 so as to sense the temperature at the area adjacent to the door 45 in the fresh food compartment 42, and a cooling compartment temperature sensor 65 disposed adjacently to the rear inner surface of the fresh food compartment 42 so as to sense the temperature at the area distant from the door 45 in the fresh food compartment 42. The temperatures sensed respectively by the two temperature sensors 63, 65 are inputted into the microprocessor. If the difference between the two temperatures sensed by the temperature sensors 63, 65 becomes more than a predetermined value, in other words if the temperature at the area adjacent to the door 45 which is sensed by the door temperature sensor 63 is higher than the temperature at the rear area in the door 45 which is sensed by the cooling compartment sensor 65 at more than the predetermined value, the microprocessor drives the blowing fan 31 so as to supply the door duct 30 with the cool air.

At the rear inner surface of the fresh food compartment 42, a plurality of the rear cool air openings 38 are formed, and at the side inner surfaces of the fresh food compartment 42, a plurality of the side cool air openings 58 are formed. When the door 45 is closed, the cool air from the evaporator 49 is supplied into the fresh food compartment 42 through each cool air opening 38, 58, and accordingly the foodstuffs stored in the fresh food compartment are cooled.

Hereinbelow the operation and the effect of the refrigerator according to the present invention will be described.

When the closing of the door 45 is sensed through the push button switch 60, the microprocessor drives the blowing fan 31 and the cooling fan 39 on the basis of the temperatures sensed by the temperature sensors 63, 65. That is, if the temperatures in the fresh food compartment 42 sensed by two temperature sensors 63, 65 are lower than a temperature corresponding to the degree of cooling set by a user, the blowing fan 31 and the cooling fan 39 operate, and the cool air is supplied into the fresh food compartment 42. At that situation, the cool air is discharged into the fresh food compartment 42 from each inner surface thereof through each cool air opening 38, 58, and since the cool air suction port 53 of door duct 50 is combined with the cool air discharge port of the cool air duct 33 the blown air into the cool air duct 33 is discharged from the inner surface of the door 45 through the cool air supply ports 51 of the door duct 50. Accordingly, the cool air is supplied into the fresh food compartment 42 from four inner surfaces, which are the rear inner surface, two side inner surfaces, and inner surface of the door 45, of the fresh food compartment 42. Furthermore, if the temperature sensed by the door temperature sensor 63 is higher than the temperature in the fresh food compartment 42 sensed by the cooling compartment temperature sensor 65 at more than the predetermined value, the microprocessor also drives the cooling fan 49 and the blowing fan 31 so as to supply the fresh food compartment 42 with the cool air from the four inner surfaces. Accordingly, the uniform supply of the cool air into the fresh food compartment 42 and maintenance of the even distribution of cooling degree in the fresh food compartment 42 can be achieved.

When the opening of the door 45 is sensed through the push button switch 60, the microprocessor drives the blowing fan 31 irrespective of the temperatures sensed by the temperature sensors 63, 65. At that situation, since the door duct 33 is detached from the cool air duct 33, the cool air supplied into the cool air duct 33 is discharged downward through the cool air discharge port 35, and accordingly the air curtain shutting off the opening of the fresh food compartment 42 is formed. Thus, the leakage of cool air when the door 45 is opened is eliminated and the cool air in the fresh food compartment 42 is preserved.

As described above, according to the present invention, the leakage of the cool air is eliminated by the air curtain when the door is opened and the cool air is supplied from the door when the door is closed, and thus the maintenance of the uniform cooling intensity in the fresh food compartment can be achieved.

Although the present invention has been described and illustrated in detail, it is clearly understood that the same is by way of illustration and example only and is not to be taken by way of limitation wherein the spirit and scope of the present invention is limited only by the terms of the appended claims.

What is claimed is:

1. A refrigerator having a cabinet forming a cooling compartment of which a side is open, a door for opening/closing an opening of said cabinet, and an evaporator for generating cool air, said refrigerator comprising:

a device for generating an air curtain, said device having a cool air duct which has a cool air discharge port opened at an area adjacent to the opening of said cabinet and a means for blowing the cool air generated by said evaporator into said cool air duct, said air curtain for shutting off the opening of said cabinet with cool air discharged through the cool air discharge port;

a door duct being disposed in said door and having a cool air suction port which is combined with the cool air discharge port when said door is closed and a plurality of cool air supply ports opened at an inner surface of said door, said door duct for supplying the cooling compartment with the cool air provided from said device through the cool air discharge port when said door is closed;

a door temperature sensor disposed adjacently to the inner surface of said door so as to sense a temperature at an area adjacent to said door in the cooling compartment; and a cooling compartment temperature sensor disposed adjacently to an inner surface of said cooling compartment which is opposite to the inner surface of said door so as to sense a temperature at a area distant from said door in the cooling compartment;

wherein said blowing means is controlled to operate when the temperature sensed by said door temperature sensor is higher than the temperature sensed by said cooling compartment temperature sensor.

2. The refrigerator as claimed in claim 1, wherein the cool air discharge port is disposed at an upper side of the cooling compartment and opened downward.

3. The refrigerator as claimed in claim 1, wherein said blowing means is a cross flow fan.

4. The refrigerator as claimed in claim 1, further comprising a means for sensing opening/closing of said door, wherein said blowing means is controlled to operate when an opened state of said door is sensed by said opening/closing sensing means.

5. The refrigerator as claimed in claim 1, a plurality of cool air openings for supplying the cool air generated by said evaporator are formed at each inner surface of the cooling compartment.

6. A refrigerator having a cabinet forming a cooling compartment of which a side is open, a door for opening/closing an opening of said cabinet, and an evaporator for generating cool air, said refrigerator comprising:

a device for generating an air curtain, said device having a cool air duct which has a cool air discharge port opened downward at an area adjacent to an upper side of the opening of said cabinet and a means for blowing the cool air generated by said evaporator into said cool air duct, said air curtain for shutting off the opening of said cabinet with cool air discharged downward through the cool air discharge port;

a door duct being disposed in said door and having a cool air suction port which is combined with the cool air discharge port when said door is closed and a plurality of cool air supply ports opened at an inner surface of said door, said door duct for supplying the cooling compartment with the cool air provided from said device through the cool air discharge port when said door is closed;

a means for sensing temperatures at an area adjacent to said door in the cooling compartment and at a distant area from said door in the cooling compartment; and a means for sensing opening/closing of said door, wherein said blowing means is controlled to operate when a temperature at an adjacent area to said door is higher than a temperature at a distant area from said door and when an opened state of said door is sensed by said opening/closing sensing means.

* * * * *